United States Patent [19]

Gambertoglio

[11] Patent Number: 4,694,878

[45] Date of Patent: Sep. 22, 1987

[54] DISCONNECT SUB FOR A TUBING CONVEYED PERFORATING GUN

[75] Inventor: Louis M. Gambertoglio, The Woodlands, Tex.

[73] Assignee: Hughes Tool Company, Houston, Tex.

[21] Appl. No.: 886,273

[22] Filed: Jul. 15, 1986

[51] Int. Cl.[4] ..... E21B 23/00; E21B 43/11

[52] U.S. Cl. ..... 166/377; 166/55.1; 166/297; 175/4.56

[58] Field of Search ..... 166/377, 297, 63, 55.1, 166/117; 175/4.52, 4.53, 4.54, 4.55, 4.56

[56] References Cited

U.S. PATENT DOCUMENTS

| | | | |
|---|---|---|---|
| 2,876,843 | 3/1959 | Huber | 175/4.56 |
| 3,366,182 | 1/1968 | Solum | 166/208 |
| 4,040,482 | 8/1977 | Vann | 166/255 |
| 4,364,587 | 12/1982 | Samford | 285/3 |
| 4,523,643 | 1/1985 | McGlothen | 166/297 |
| 4,526,233 | 7/1985 | Stout | 166/377 |
| 4,554,981 | 12/1985 | Davies | 175/4.52 |
| 4,557,331 | 12/1985 | Stout | 166/297 |
| 4,560,000 | 12/1985 | Upchurch | 166/55.1 |
| 4,616,718 | 10/1986 | Gambertoglio | 166/297 X |
| 4,633,945 | 1/1987 | Upchurch | 166/55.1 |

FOREIGN PATENT DOCUMENTS

| | | | |
|---|---|---|---|
| 2486143 | 1/1982 | France | 166/316 |

*Primary Examiner*—Stephen J. Novosad
*Assistant Examiner*—David J. Bagnell
*Attorney, Agent, or Firm*—Charles D. Gunter, Jr.

[57] ABSTRACT

A disconnect sub for a tubing conveyed perforating gun is shown which includes a tubular member and a sliding mandrel telescopingly received within the interior of the tubular member. A perforating gun is supported by the lower end of the sliding mandrel and the mandrel has an upper colleted end which is initially retained within the tubular member on an internal profile. A retaining sleeve has a lower extent which initially underlies the colleted end of the sliding mandrel within the tubular member. After firing the perforating gun, the sliding mandrel is released by draining an initially filled fluid chamber within the device and by locking the retaining sleeve out of engagement with the colleted end of the mandrel, thereby allowing the mandrel to slide from within the tubular member and fall away within the well bore.

7 Claims, 8 Drawing Figures

DISCONNECT SUB FOR A TUBING CONVEYED PERFORATING GUN

BACKGROUND OF THE INVENTION

1. Field of the Invention.

The present invention relates generally to a tubing conveyed perforating gun of the type used to perforate a cased well bore for the production of well bore fluids and, specifically, to a shock absorbing sub which automatically disconnects the perforating gun from the tubing string when the gun has been fired.

As oil and gas well bores are drilled, the integrity of the bore hole is preserved by cementing a casing or liner in place in the bore hole. The casing or liner is a metal, cylindrical conduit which must be punctured or perforated over the desired production interval in order to produce well bore fluids once drilling is complete. A perforating gun which utilizes some form of fired projectile and an explosive charge is used to perforate the casing or liner to begin production from the well.

Prior perforating gun techniques have either utilized tools which were run on a wireline or cable or have utilized tubing conveyed devices which were run on a tubing string to the desired depth in the well bore. Tubing conveyed devices have certain advantages over wireline methods, for example, in allowing safe, immediate release of formation pressure at maximum pressure differentials into the tubing string. With tubing conveyed perforating systems, the tubing can be run into position, a packer set to seal off a well bore, and the surface wellhead equipment can be installed. The packer setting can be checked by circulating fluid under pressure through the well annulus or through the well tubing string. Once the top side work is completed and tested for safety, the perforating gun can be fired to bring in the well. Since all surface work is completed before the perforating gun is fired, operating safety is enchanced.

Once the perforating gun has been fired and the casing is perforated, it is desirable to release the perforating gun portion of the device from the remainder of the tubing string leading to the well surface. This provides a greater flow area through the tubing string for production of well bore fluids and also allows tools and other devices to be run through the interior bore of the tubing string without contacting the perforating gun apparatus.

The present invention has as its object the provision of a disconnect sub for incorporation in a well tubing string between the perforating gun and the remainder of the string leading to the well surface, the sub service to automatically disconnect the perforating gun from the remainder of the tubing string once the gun has fired.

Another object of the present invention is the provision of such a disconnect sub which absorbs the impact of upward movement of the tubing string, usually thrust against the packer, caused by firing of the perforating gun.

BRIEF SUMMARY OF THE INVENTION

The disconnect sub of the invention is designed for use with a tubing conveyed perforating gun of the type used to perforate a cased well bore. The disconnect sub includes a tubular member having a generally cylindrical exterior and an interior bore. The tubular member has an upper connecting end for connection in a tubing string extending to the well surface and a lower end. A sliding mandrel is telescopingly received within the interior bore of the tubular member. The sliding mandrel has a lower end with connecting means for engaging and supporting the perforating gun and an upper colleted end with a plurality of collet fingers which terminate in collet lugs. The fingers are expandable radially inwardly and outwardly, and the interior bore is provided with an internal profile for engaging the collet lugs when the fingers are expanded radially outwardly.

A retaining sleeve is received within the interior bore of the tubular member. The sleeve has a lower cylindrical extent which initially underlies the collet lugs and biases the lugs radially outwardly to engage the internal profile and define a running-in position of the tool. The retaining means is movable to a release position upon upward sliding movement of the mandrel in which the fingers are disengaged to release the sliding mandrel. Lock means within the interior bore engage the retaining sleeve in the release position. Upon upward travel of the mandrel and retaining sleeve over a predetermined distance.

The mandrel is preferably provided having a region of reduced external diameter which forms an annular chamber between the mandrel exterior and the interior bore. The annular chamber is filled with a substantially incompressible fluid. Drain means initially contain the fluid within the chamber and include a frangible portion which extends within the internal bore of the mandrel, whereby a weight dropped through the tubing string and, in turn, through the internal bore, severs the frangible portion to release the fluid. Release of the fluid from the annular chamber allows the sliding mandrel and retaining sleeve to move upwardly to the release position.

Additional objects, features and advantages will be apparent in the written description which follows.

DETAILED DESCRIPTION OF THE INVENTION

Figure 1A:
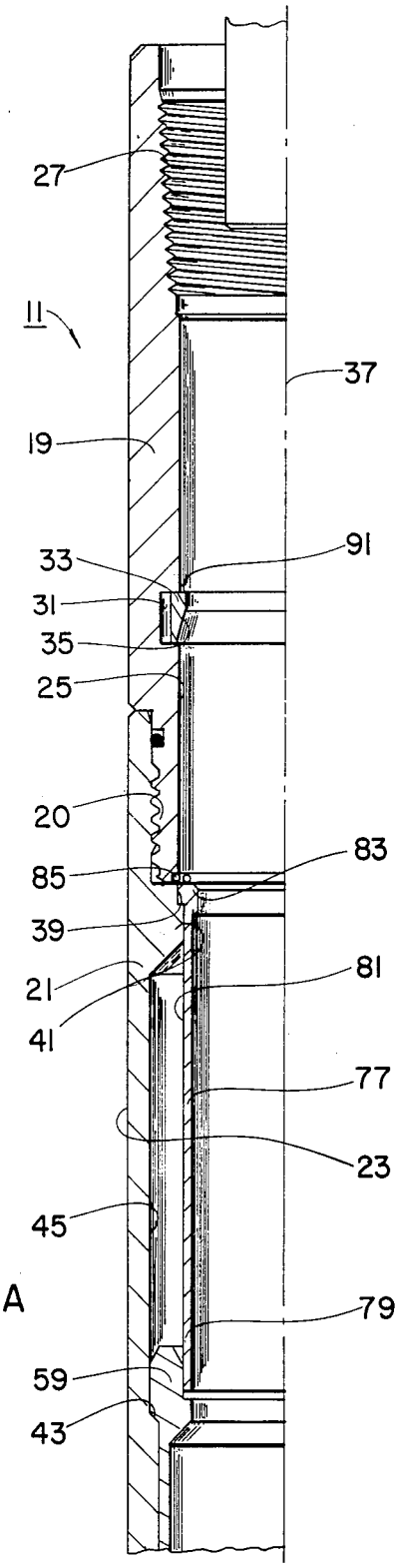
FIG. 1A is a side cross-sectional view of the upper end of the disconnect sub of the invention in the running-in position.
Figure 1B:
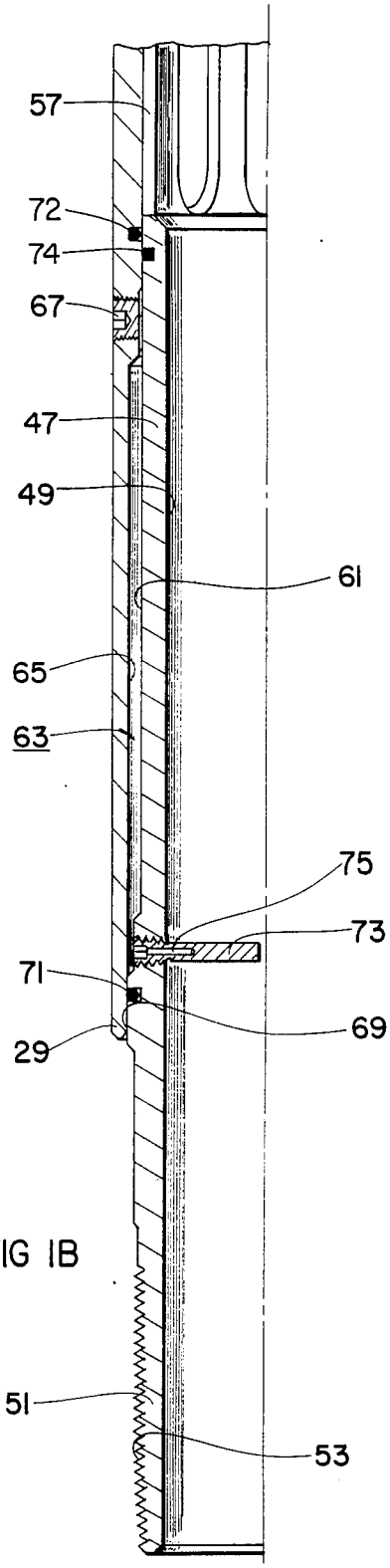
FIG. 1B is a downward continuation of FIG. 1A showing the annular chamber and frangible drain means of the invention.
Figure 3:
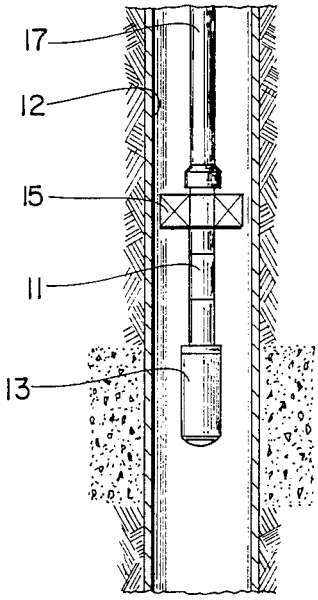
FIG. 3 is a schematic view of the apparatus of the invention being run into position within a well bore on a well tubing string.

Turning to FIGS. 1A–1B there is shown a disconnect sub of the invention, designated generally as 11. the disconnect sub 11 is adapted to be used with a tubing conveyed perforating gun of the type known in the art which is used to perforate a case well bore. FIG. 3 shows a simplified schematic view of a typical perforating system which includes a perforating gun 13 which is coupled to the disconnect sub 11, both of which are run below a well packer 15 which is carried on a well tubing string 17 extending to the well surface. The disconnect sub 11 can be either directly connected to the perforating gun 13 or can be connected by an intermediate length of tubing to the perforating gun.

The disconnect sub, as shown in FIG. 1A, includes a tubular member having an upper extent 19 joined at a threaded connection 20 to a lower extent 21. The tubular member has a generally cylindrical exterior 23 and an interior bore 25. The tubular member also has an upper connecting end 27 which threadedly engages the mating connecting end (not shown) of the tubing string 17 extending to the well surface, and has a lower end 29. The interior bore 25 of the tubular member communicates with the interior of the tubing string 17 leading to the well surface.

As shown in FIG. 1A, the upper extent 19 of the tubular member has a circumferential retaining groove 31 which is adapted to receive a snap ring 33. The snap ring 33 is a circular metallic ring which is split at one point in the circumference thereof to allow the ring 33 to be expanded radially outwardly within the groove 31. The interior of the snap ring 33 has a lower tapered surface 35 which slants inwardly in the direction of the longitudinal axis 37 of the device.

The interior bore 25 of the tubular member has an upper ledge 39 formed by a region of increased internal diameter 41 and a lower internal profile 43 separated from the ledge 39 by a region of decreased internal diameter 45.

A sliding mandrel 47 (FIG. 1B) is telescopingly received within the interior bore of the tubular member. The sliding mandrel has an internal bore 49 which communicates with the interior bore 25 of the tubular member and, in turn, with the interior of the tubing string leading to the well surface. The sliding mandrel 47 also has an externally threaded lower end 51 with connecting means 53 for engaging and supporting the perforating gun (13 in FIG. 3), it being understood that intermediate lengths of tubing can be installed between the lower end 51 and the perforating gun 13. The sliding mandrel 47 also has an upper colleted end with a plurality of collet fingers 57 which terminate in collet lugs 59 which, in the running-in position shown in Figs. 1A–1B are expanded radially outwardly to engage the internal profile 43 of the tubular member.

The sliding mandrel 47 has an external region 61 which forms an annular chamber 63 between the mandrel exterior 61 and the interior side wall 65 of the tubular member. The annular chamber 63 is initially filled with a substantially incompressible fluid, such as an oil, by means of a fill port 67. The external region 62 of the sliding mandrel increases in external diameter, at the lower end thereof, to form a piston area 69 which, together with O-ring seal 71 and O-ring seals 72,74, would tend to compress the fluid within chamber 63 upon upward movement of the sliding mandrel 47 relative to the tubular member.

The sliding mandrel also has a drain means for initially containing the fluid within the chamber 63. The drain means, preferably includes a frangible portion, such as hollow pin 73, which extends within the internal bore 49 of the mandrel, whereby a weight dropped through the internal bore severs the frangible portion to release the fluid through the passageway 75.

A retaining sleeve 77 is received within the interior bore 25 of the tubular member. The retaining sleeve 77 has a lower cylindrical extent 79 which initially underlies the collet lugs 59 of the sliding mandrel and biases the lugs radially outwardly to engage the internal profile 43 and define a running-in position for the device. The retaining sleeve 77 is a generally cylindrical body having an external surface 81 which increases in diameter at an upper extent thereof to form a lip 83, the lip being received upon the ledge 39 formed within the interior bore 25 when the sleeve is in the running-in position. The retaining sleeve 77 also has a region of decreased internal diameter 78 which forms an internal shoulder, engagable by a wireline release tool (not shown) which can subsequently be latched into the bore of the sleeve 77, as will be explained. Shear means, such as circumferential shear wire 85 initially fix the retaining sleeve 77 in the running-in position, the shear means being severable upon the application of a predetermined shear force caused by upward axial travel of the sliding mandrel 47 and retaining sleeve 77.

The operation of the disconnect sub of the invention will now be described. The upper connecting end 27 is connected to the lower end of the well tubing string extending to the well surface, as shown in FIG. 3. The lower end 51 is threadedly connected to the mating upper end of the perforating gun 13 or to the tubing string extending to the perforating gun if an intermediate length of tubing string is used. The perforating gun 13 is actuated by a weight passing down the interior of the tubing string from the well surface and contacting a percussion detonator. Such perforating devices are well known in the art. For instance, U.S. Pat. No. 2,876,843 to Huber, issued Mar. 10, 1959, the disclosure of which is hereby incorporated by reference, shows a tubing conveyed perforating apparatus in which a weight contacts a percussion detonator to fire the perforating guns.

Figure 4:
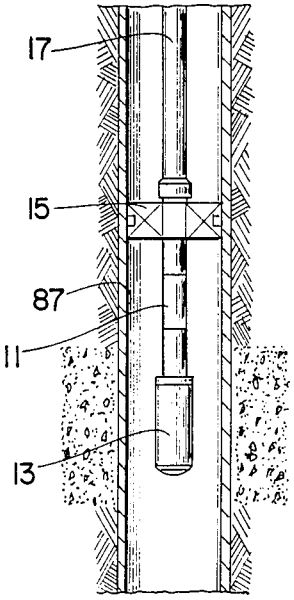
FIG. 4 is a schematic view similar to FIG. 3 showing a well packer on the well tubing string which has been actuated to seal off the well bore.

In the running-in position, the sliding mandrel 47 and retaining sleeve 77 are in the positions shown in FIGS. 1A–1B and the chamber 63 is filled with fluid. Frangible pin 73 contains the fluid within the chamber 63. As shown in FIG. 3, the perforating gun 13 is then run to the proper depth in a well bore which is lined by casing 12. The packer is then set, as shown in FIG. 4, to isolate the production zone 87 from the annular space between the tubing string and well bore 12 above the packer.

Figure 2A:
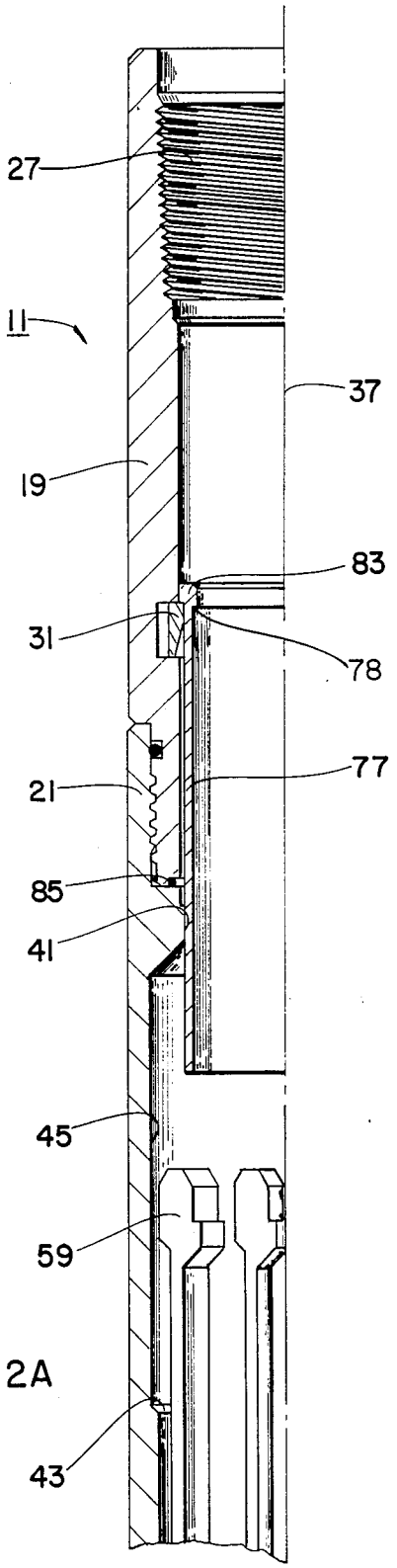
FIG. 2A is a side, cross-sectional view, similar to FIG. 1A, but showing the apparatus in the release position with the lock means engaging the retaining sleeve.
Figure 2B:
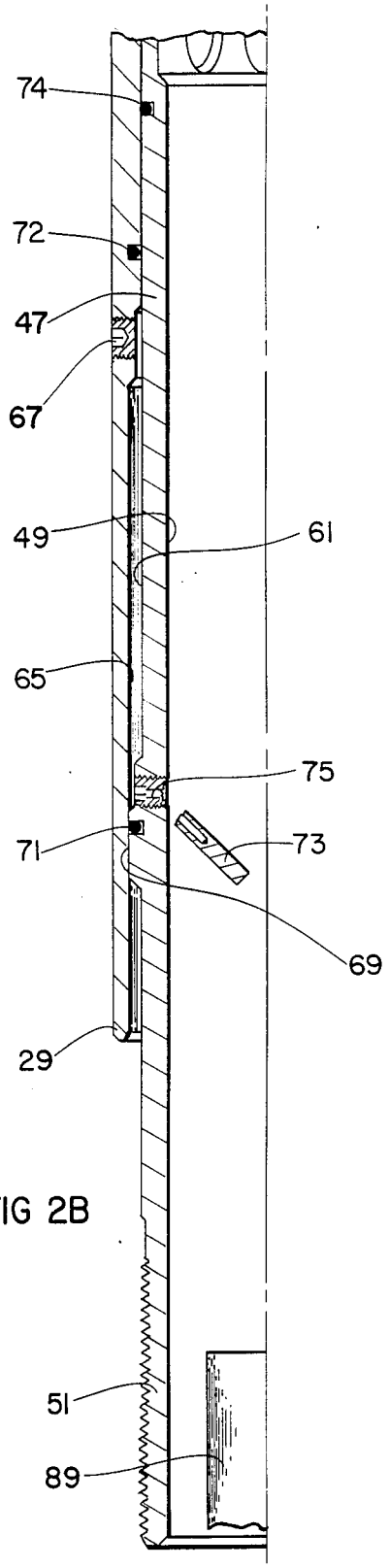
FIG. 2B is a downward continuation of FIG. 2A showing the release of the sliding mandrel.
Figure 5:
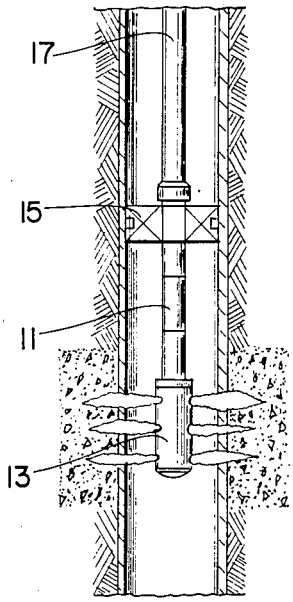
FIG. 5 is a schematic view of the apparatus showing the firing of the perforating gun.

In order to fire the perforating gun, a weight, such as iron bar 89 in FIG. 2B is then dropped through the interior of the tubing string and through the internal bore 49, striking the hollow pin 73 and opening the passageway 75. The bar 89 continues down the internal bore 49 to strike the percussion detonator and fire the explosive charges of the perforating gun, as shown in FIG. 5. The reaction caused by the explosive charges of the perforating gun causes the sliding mandrel 47 to move axially upwardly with respect to the tubular member. As shown in FIGS. 1A–1B, upward axial movement of the sliding mandrel 47 causes the retaining sleeve 77 to travel upwardly within the interior bore 25, so that lip 83 contacts the tapered surface 35 and expands the snap ring 33 radially outwardly within the groove 31. As the lip 83 passes over the upper surface 91 of snap ring 33, the snap ring 31 moved radially inwardly to engage the lip 83, as shown in FIG. 2A. As the sliding mandrel moves upwardly, the piston area 69 tends to compress the fluid within chamber 63 causing the fluid to be metered through the passageway 75 into the internal bore 49. This movement of fluid acts as a shock absorber and slows the upward travel of the sliding mandrel so that the device absorbs the impact of upward movement, which would otherwise be thrust against the packer, possibly damaging the packer.

Figure 6:
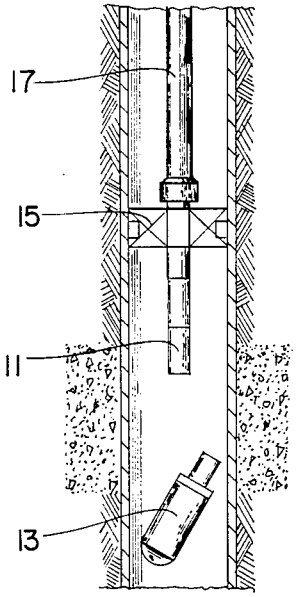
FIG. 6 is a schematic view of the apparatus showing the release of the perforating gun from the remainder of the well tubing string.

After the detonation of the perforating gun, the sliding mandrel 47 beings to travel axially downwardly. Since the retaining sleeve 77 is now engaged in the release position shown in FIG. 2A, the collet lugs 59 are free to spring radially inwardly, and the sliding mandrel can travel past the internal profile 43, thereby allowing the mandrel and attached perforating gun 13 to fall from the tubing string, as shown in FIG. 6.

The internal shoulder 78 in the retaining sleeve 77 allows the device to be released mechanically by lowering a suitable wireline tool with a mating latch to engage the shoulder 78. After engaging the shoulder 78, the wireline tool would then be pulled upwardly, pulling the sleeve 77 from beneath collet lugs 59 and allowing release of the sliding mandrel 47.

An invention has been provided with several advantages. The disconnect sub of the invention automatically disconnects the perforating gun after the guns have fired without the necessity of a wireline run or the use of hydraulic pressure through the tubing string. The fluid chamber and drain means absorb the impact of upward movement of the gun which would otherwise be thrust against the packer, before damage occurs to the packer or accessories. While running into the well bore, the fluid chamber and a shear means hold the parts of the device in the running-in position to prevent the tool from disconnecting prematurely. The disconnect sub can be connected to any conventional perforating gun and can be placed anywhere in the tubing string below the packer and above the firing head of the perforating gun.

While the invention has been shown in only one of is forms, it is not thus limited but is susceptible to various changes and modifications without departing from the spirit thereof.

I claim:

1. A disconnect sub for a tubing conveyed perforating gun of the type used to perforate a cased well bore, comprising:

a tubular member having a generally cylindrical exterior and an interior bore, said tubular member having an upper connecting end for connection in a tubing string extending to the well surface and a lower end;

a sliding mandrel telescopingly received within the interior bore of said tubular member, said sliding mandrel having a lower end with connecting means for engaging and supporting said perforating gun and an upper colleted end with a plurality of collet fingers which terminate in collet lugs, said fingers being expandible radially inwardly and outwardly, and wherein said interior bore is provided with an internal profile for engaging said collet lugs when said fingers are expanded radially outwardly;

a retaining sleeve received within the interior bore of said tubular member, said sleeve having a lower cylindrical extent which initially underlies said collet lugs and biases said lugs radially outwardly to engage said internal profile and define a running-in position, said retaining sleeve being movable to a release position upon upward sliding movement of said mandrel in which said fingers are disengaged to release said sliding mandrel;

lock means within said interior bore for engaging said retaining sleeve in said release position upon upward travel of said mandrel and retaining sleeve over a predetermined distance; and wherein said retaining sleeve is a generally cylindrical body, said body having an external surface which increases in diameter at an upper extent thereof to form a lip, said lip being received upon a ledge formed within said interior bore when said sleeve is in said running-in position.

2. The disconnect sub of claim 1, further comprising:

shear means for initially fixing said retaining sleeve in said running-in position, said shear means being severable by upward axial travel of said sliding mandrel and retaining sleeve.

3. A disconnect sub for a tubing conveyed perforating gun of the type used to perforate a cased well bore, comprising:

a tubular member having a generally cylindrical exterior and an interior bore, said tubular member having an upper connecting end for connection in a tubing string extending to the well surface and a lower end;

a sliding mandrel telescopingly received within the interior bore of said tubular member, said sliding mandrel having a lower end with connecting means for engaging and supporting said perforating gun and an upper colleted end with a plurality of collet fingers which terminate in collet lugs, said fingers being expandible radially inwardly and outwardly, and wherein said interior bore is provided with an internal profile for engaging said collet lugs when said fingers are expanded radially outwardly;

a retaining sleeve received within the interior bore of said tubular member, said sleeve having a lower cylindrical extent which initially underlies said collet lugs and biases said lugs radially outwardly to engage said internal profile and define a running-in position, said retaining sleeve being movable to a release position upon upward sliding movement of said mandrel in which said fingers are disengaged to release said sliding mandrel, and wherein said retaining sleeve is a generally cylindrical body, said body having an external surface which increases in diameter at an upper extent thereof to form a lip, said lip being received upon a ledge formed within said interior bore when said sleeve is in said running-in position;

lock means within said interior bore for engaging said retaining sleeve in said release position upon upward travel of said mandrel and retaining sleeve over a predetermined distance, and wherein said lock means is a snap ring which is located within a retaining groove provided within said interior bore, upward axial travel of said sliding mandrel and retaining sleeve serving to engage the lip of said sleeve with said snap ring to lock said sleeve in said release position; and shear means for initially fixing said retaining sleeve in said running-in position, said shear means being severable by upward axial travel of said sliding mandrel and retaining sleeve.

4. A disconnect sub for a tubing conveyed perforating gun of the type used to perforate a cased well bore, comprising:

a tubular member having a generally cylindrical exterior and an interior bore, said tubular member having an upper connecting end for connection in a tubing string extending to the well surface and a lower end;

a sliding mandrel telescopingly received within the interior bore of said tubular member, said sliding mandrel having an internal bore, a lower end with connecting means for engaging and supporting said perforating gun and an upper colleted end with a plurality of collet fingers which terminate in collet lugs, said fingers being expandable radially inwardly and outwardly, and wherein said interior bore is provided with an internal profile for engaging said collet lugs when said fingers are expanded radially outwardly, and said mandrel having a region of reduced external diameter which forms an annular chamber between said mandrel exterior and said interior bore, said annular chamber being initially filled with a substantially incompressible fluid;

drain means initially containing said fluid within said chamber, said drain means including a frangible portion which extends within the internal bore of said mandrel, whereby a weight passing through said tubing string and, in turn, through said internal bore severs said frangible portion to release said fluid;

a retaining sleeve receive within the interior bore of said tubular member, said sleeve having a lower cylindrical extent which initially underlies said collet lugs and biases said lugs radially outwardly to engage said internal profile and define a running-in position said retaining means being movable to a release position upon upward sliding movement of said mandrel in which said fingers are disengaged to release said sliding mandrel; and lock means within said interior bore for engaging said retaining sleeve in said release position upon upward travel of said mandrel and retaining sleeve over a predetermined distance.

5. The disconnect sub of claim 4, wherein said drain means is a hollow pin.

6. The disconnect sub of claim 4, wherein the exterior of said mandrel is provided with a seal region which forms a piston area within said chamber, whereby upward movement of said mandrel compresses said fluid and acts to retard the travel of said mandrel.

7. A method of disconnecting a tubing conveyed perforating gun of the type having a percussion detonator used to perforate a cased well bore, comprising the steps of:

connecting a tubular member having an interior bore within an internal profile in a well tubing string and positioning a sliding mandrel within the interior bore in telescoping fashion, the sliding mandrel having a lower end connected to the perforating gun for supporting the gun, the mandrel being provided with a colleted upper end having a plurality of collet fingers expandible radially inwardly and outwardly for engaging the internal profile;

retaining the mandrel within the tubular member by installing a retaining sleeve above the sliding mandrel within the tubular member, the sleeve being provided with a lower cylindrical extent which initially underlies said collet fingers and biases said fingers radially outwardly to engage said internal profile and define a running-in position, said retaining sleeve being movable to a release position upon upward sliding movement of said mandrel in which said fingers are disengaged to release said sliding mandrel;

providing locking means within said interior bore for engaging said retaining sleeve in said release position upon upward travel of said mandrel and retaining sleeve over a predetermined distance;

providing a region of reduced external diameter which forms an annular chamber between the exterior of said mandrel and said interior bore, and filling said chamber with a substantially incompressible fluid;

providing drain means initially containing said fluid within said chamber, said drain means including a frangible portion which extends within the internal bore of said mandrel; and passing a weight through said tubing string from the well surface through said internal bore to sever said frangible pin and drain said chamber, said weight being allowed to continue down said internal bore to contact said percussion detonator and fire said perforating gun.

* * * * *